United States Patent [19]

Freeman

[11] Patent Number: 4,618,205

[45] Date of Patent: Oct. 21, 1986

[54] LIGHT FIXTURE

[75] Inventor: Jerry H. Freeman, Mt. Prospect, Ill.

[73] Assignee: UNR, Inc., Chicago, Ill.

[21] Appl. No.: 800,367

[22] Filed: Nov. 21, 1985

Related U.S. Application Data

[63] Continuation of Ser. No. 586,350, Mar. 5, 1984, abandoned.

[51] Int. Cl.[4] ..... H01R 13/432/13/11

[52] U.S. Cl. ..... 339/125 L; 313/318; 339/176 L; 339/195 L; 339/217 S; 339/258 F

[58] Field of Search ..... 313/318; 339/10, 17 D, 339/125 L, 144 R, 176 L, 195 R, 195 M, 198 J, 217 S, 258 F, 258 S, 195 L

[56] References Cited

U.S. PATENT DOCUMENTS

| | | | |
|---|---|---|---|
| 2,841,773 | 7/1958 | Shumate | 339/198 J |
| 2,974,302 | 3/1961 | Ellis | 339/195 M X |
| 3,676,834 | 7/1972 | Kaldor et al. | 339/176 L X |
| 3,678,261 | 7/1972 | McNeil | 339/176 L X |
| 3,681,741 | 8/1972 | Lichte | 339/176 L X |
| 3,801,810 | 4/1974 | Smith | 339/176 L X |
| 3,936,131 | 2/1976 | Durand | 339/176 L X |
| 4,180,390 | 1/1980 | Aizawa | 339/176 L X |
| 4,239,321 | 12/1980 | Bauer | 339/217 S X |
| 4,264,117 | 4/1981 | Pritulsky | 339/125 L X |

FOREIGN PATENT DOCUMENTS

| | | | |
|---|---|---|---|
| 1564679 | 2/1968 | France | 339/176 L |
| 1326018 | 8/1973 | United Kingdom | 339/176 L |

*Primary Examiner*—Gil Weidenfeld
*Assistant Examiner*—Steven C. Bishop
*Attorney, Agent, or Firm*—Dressler, Goldsmith, Shore, Sutker & Milnamow, Ltd.

[57] ABSTRACT

A light fixture for receipt of a wedge base bulb which is adapted to be surface mounted. The fixture includes a base plate member having a front side and a rear side. A socket member is molded integrally with the base member and extends outwardly from the rear side thereof. The socket member has a front section for receipt of a portion of the bulb and a rear section for receipt of the base portion of the bulb. The rear section is formed with a pair of spaced apart channels which receive and retain connector pins therein. The connector pins are formed to cooperate with surfaces formed in the channels to snap the connector pins in position within the rear section of the base portion. The connector pins have a lead receiving end portion and a bulb receiving end portion. The lead receiving end portion is formed as a male portion of a spade-type connector. The bulb receiving end portion is formed with clip sections which receive and retain the base portion of the bulb and contact the contact leads of the bulb. A lens member is received in covering relationship to the front side of the base member.

6 Claims, 6 Drawing Figures

12
10
32
34
30
38
40
16
36

92
88
86
102
90
94
98
101
104
96
100

12
18
20
16
24
28
64
4.
14
26
22
28
60
86

42
40
5.
12
96
46
44
52
73
90
60
94
48
54
73
90
102
86
84
50
84
86
80
88
92
92
88
5.

102
80
96
82
72
102
82
94
88
94
96
88
66
74
76
102
82
78
82
102

12
40
64
68
60
82
54
66
94
84
106
88
98
56
102
100
80
92
86
48
96
106
82
42
62
70
6.
6.

LIGHT FIXTURE

This application is a continuation, of application Ser. No. 586,350, filed Mar. 5, 1984, now abandoned.

BACKGROUND OF THE INVENTION

The present invention is directed to an improved light fixture and in particular to an improved light fixture adapted to receive a wedge base automotive bulb.

Various types of light fixtures have been proposed for receipt of wedge base automotive bulbs such as the "194" automotive bulb. These fixtures have typically included a separate base plate member which receives a socket member. The socket member is typically secured to the base plate member through a bayonette type attachment arrangement. The socket member is typically provided with connector pins to receive the base portion of the bulb and for connection to appropriate lead wires. Accordingly, the assembly of these light fixtures requires the separate steps of assembling the socket member to the base plate member and the attachment of the connector pins to the socket member.

It is desirable to provide a light fixture which can receive a wedge base light bulb which does not require the separate assembly of the base plate member to the socket member. It is further desirable that the socket member cooperates with the connector pins to facilitate the assembly and retention of the connector pins within the socket member.

SUMMARY OF THE INVENTION

The light fixture of the present invention is specifically designed for receipt of a wedge base light bulb such as a "194" automotive bulb and other similar bulbs which may presently be available or which may become available in the future. Such bulbs have a relatively flat connecting base portion which is formed with a pair of spaced apart side sections that are separated by an outwardly extending central section. Each of the side sections have contact leads in contact with the outer surfaces thereof. It is through these contact leads which electrical energy is supplied to the filament of the bulb.

An improved light fixture is provided to receive such bulbs which has an integrally formed and molded base member and socket member that can be wired safely, rapidly and reliably on a production basis. The fixture is provided with connector pins which serve the dual purpose of receiving and retaining the bulb and making electrical contact with lead wires in a simple and reliable manner by utilizing a releasable spade-type connector arrangement.

More specifically, the invention provides a light fixture for a wedge base light bulb adapted to be mounted on a surface comprising an electrically insulative base plate member having a front side and a rear side. The front side of the base member is suitably provided with a connecting channel for receipt of a covering lens member. A centrally disposed opening is formed through the base member in communication with an integrally molded socket member extending outwardly from the rear side of the base member. The molded socket member has a front portion for receipt and support of a portion of the bulb and a rear portion for receipt of a pair of spaced apart connector pins. The connector pins are snapped into a cooperating channel section formed in the rear portion of the molded socket member. The connector pins have a lead receiving end portion and a bulb receiving end portion. The lead receiving end portion is formed as a male portion of a spade-type connector for receipt and retention of the female portion of a spade-type connector. The bulb receiving end portion is formed with clip portions which receive and retain the side portions of the base portion of the bulb and contact the contact leads of the bulb. The specific configuration of the integrally molded socket member cooperates with the connector pins in a manner which facilitates the insertion of the connector pins thereinto and prevents the withdrawal of the connect pins therefrom. The specific configuration of the clip portions of the connector pins cooperate with the side portions of the base of the bulb in a manner which firmly receives the bulb and contacts the contact leads and readily permits removal and replacement of the bulb.

DESCRIPTION OF A PREFERRED EMBODIMENT

Figure 1:
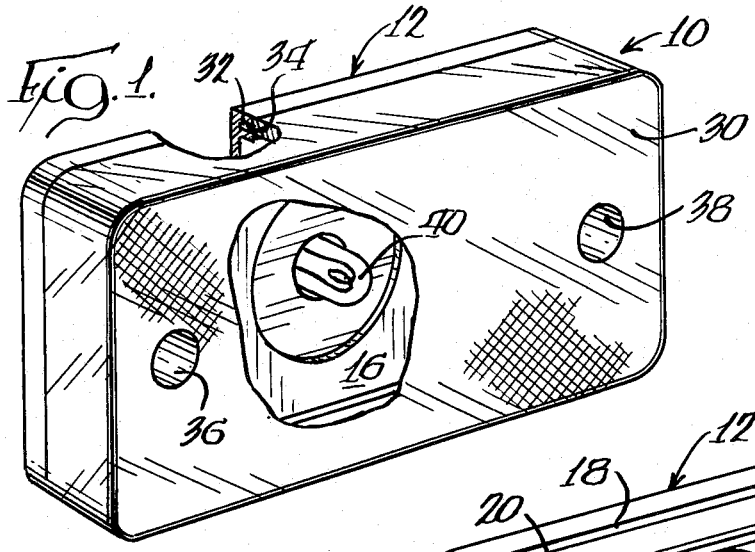
FIG. 1 is a perspective view, partially broken away, showing the light fixture of the present invention in its assembled form.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the specific embodiment.

The light fixture of the present invention is adapted to be easily secured to a generally flat surface, as to the exterior surface of a automobile, mobile home, trailer, or other vehicle, with minimum preparation of the surface for receipt of the fixture. The fixture may be attached to a surface by first cutting or punching a suitable hole in the surface through which a portion of the base member of the fixture may be inserted and through which lead wires may be drawn.

The light fixture is indicated generally at 10 and includes an electrically insulative base plate member 12 having a rear side or face 14 and a generally planar front side or face 16. The base member 12 is illustrated as being generally rectangular in plan view, although it will be appreciated that the present invention is not limited to any particular shape, and that circular, eliptical, and other shapes may be used, as desired. A pair of spaced apart peripheral ribs 18 and 20 are formed generally perpendicular to the rear side of the base member which are adapted to engage the surface upon which the fixture is mounted. Caulking or a gasket material may desirably be positioned between the surface on which the fixture is mounted and the rear side 14 between the ribs 18 and 20 to provide a water-tight seal.

The base member 12 is formed with suitable means such as holes 22 and 24 for accommodating fastening means, such as screws (not shown) for attaching the fixture to a metal surface. A pair of spaced apart circular ribs 26 and 28 are formed generally perpendicular to the rear side 14 of the base member concentric with each of the holes 22 and 24. Caulking or a gasket material may desirably be positioned between the surface on which the fixture is mounted and the rear side 14 between the ribs 18 and 20 to provide a water-tight seal.

A lens member 30 is removably secured to the front side 16 in covering relationship thereto. Referring to FIG. 1, a peripheral channel 32 is formed in front side 16 which receives an offset edge portion 34 formed integrally with the lens member. Lens member 30 has holes 36 and 38 formed in alignment with the holes 22 and 24 for receipt of the fastener means securing the base member 12 to the surface therethrough and thereby securing the lens member to the base member.

As hereinabove discussed, the light fixture 10 is specifically designed to receive a wedge base bulb such as a "194" automotive bulb. The bulb is indicated generally at 40 and includes an illuminating body portion 42 and a connecting base portion 44. The base portion is generally flat and includes a pair of flat side sections or wings 46 and 48 separated by a generally cylindrical central section 50. The contact wires 52 and 54 from the filament within the bulb extend through the respective ends of the side sections 46 and 48 and are bent upward into contact with an outer surface of the respective side section. In the specific bulb shown in the drawings, the surfaces of the side sections in contact with the contact wires 52 and 54 are on opposite sides of the base portion 44. The opposing surfaces of the side sections 46 and 48, not in contact with the contact wires 52 and 54, have a transverse recessed portion 56 formed therein, which as will become hereinbelow more apparent cooperates with the light fixture to retain the bulb securely in place.

The base member 12 includes a socket member 60, molded integrally therewith, which extends outward from the rear side 14 in communication with an opening 62 formed through a central portion of the base member. The socket 60 has a front portion 64 which receives and supports the body portion 42 of the bulb and a rear portion 66 which receives and supports the base portion 44 of the bulb.

Figure 4:
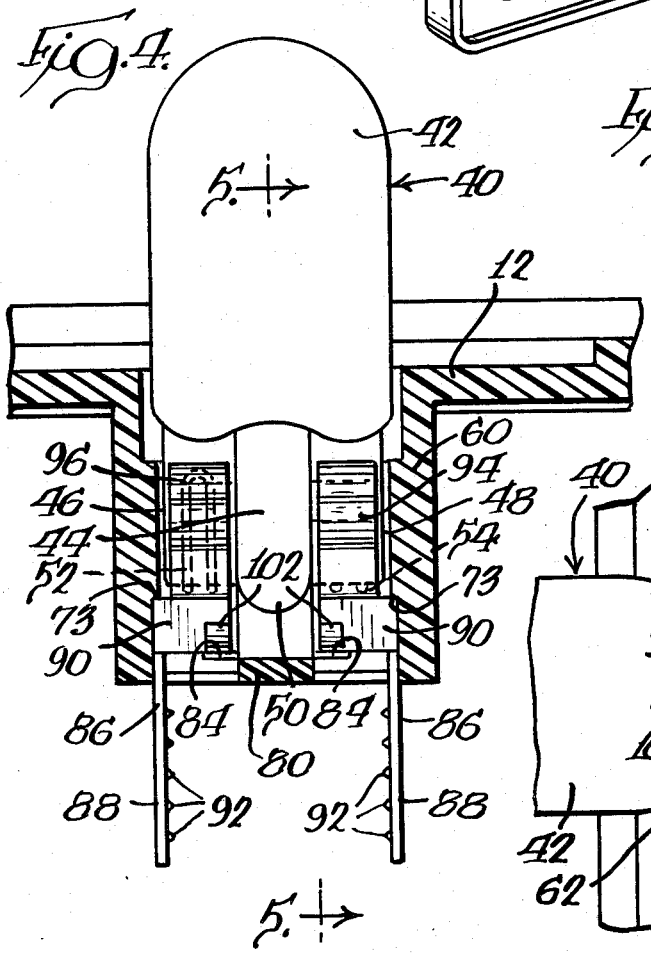
FIG. 4 is an enlarged sectional view, partially broken away, taken along line 4—4 in FIG. 2.

Referring to FIGS. 2 and 4–6, the front portion 64 is generally circular with a pair of facing surfaces 68 and 70 formed therein which incline rearwardly and inwardly towards each other so as to define a generally rectangular opening 72 at the rearward edges thereof. As seen in FIG. 4, inwardly extending ledge surfaces 73 are formed at the interface between the portions 64 and 66.

Figure 6:
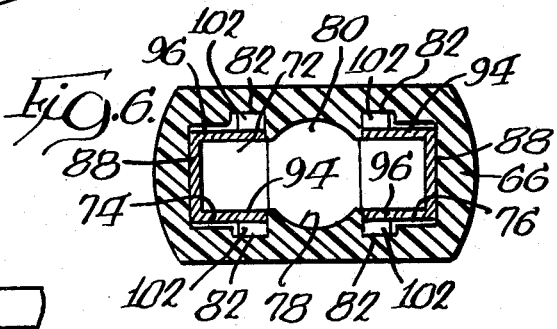
FIG. 6 is a sectional view taken along line 6—6 in FIG. 5 with the bulb removed.
Figure 5:
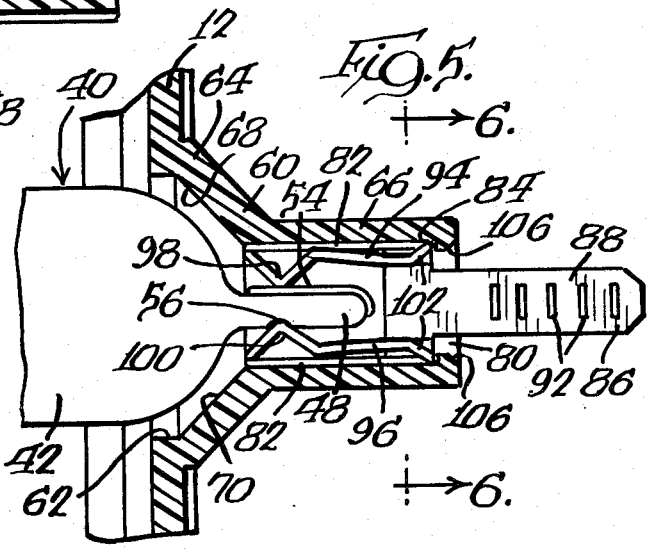
FIG. 5 is a sectional view taken along line 5—5 in FIG. 4.

The rear portion 66 is generally rectangular in shape and defines a pair of spaced apart, facing, generally rectangular channels 74 and 76, separated by a generally circular channel 78, as best seen in FIG. 6. The rearward end of channel 78 is closed off at wall section 80, whereas the rearward ends of channels 74 and 76 are open. The opposing surfaces of the channels 74 and 76 have outwardly extending grooves 82 formed therein adjacent the channel 78. The grooves 82 extend at one end from the inner edges of surfaces 68 and 70 and terminate at the other end a short distance from the rearward end of the rear portion 66 so as to define a retaining surface 84.

Figure 3:
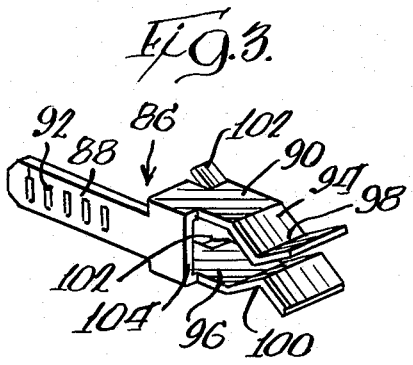
FIG. 3 is an enlarged perspective view of a connector pin formed in accordance with the invention.

Referring particularly to FIG. 3, the specific construction of the connector pins 86 in accordance with the invention will now be discussed. Each connector pin 86 is integrally formed of a suitable electrical conducting material and includes a lead receiving portion 88 and a bulb receiving portion 90.

The lead receiving portion 88 is formed to serve as a male section of a spade-type connector. Portion 88 is accordingly a generally flat strip which has projection ribs 92 formed integrally therewith to facilitate the mating receipt of a female portion of a spade-type connector.

The bulb receiving portion 90 is defined by a pair of spaced apart facing spring clip sections 94 and 96, which are formed integrally with one end of the lead receiving portion 88. The spring clip sections 94 and 96 are bent in the manner shown in FIG. 3, so as to respectively define V-shaped sections 98 and 100 having apexes which extend towards each other and are spaced a short distance apart.

It can readily be appreciated that the application of an inward force to the outer surfaces of sections 98 and 100 will cause the sections 98 and 100 to spread apart with a resulting force biasing the sections 98 and 100 to return to their original positions. As will hereinbelow become more apparent, the insertion of a side section of the base portion of the bulb between the clip sections 94 and 96 causes the sections 98 and 100 to spread apart to receive the base portion and return to their original position to retain the bulb in position. In order to maintain the connector pins 86 in position with the rear portion of the socket member, in a manner which will be hereinbelow further discussed, an ear section 102 is stamped out of the bulb receiving portion 90. The ear sections 102 extend outwardly from the edges of the sections 94 and 96 adjacent the interface with the lead receiving portion 88 and transversely spaced from the inner end thereof. It should also be noted that the inner end of the lead receiving portion 88 is offset from the clip sections 94 and 96 so as to define a surface 104, the significance of which will hereinbelow become more apparent.

Figure 2:
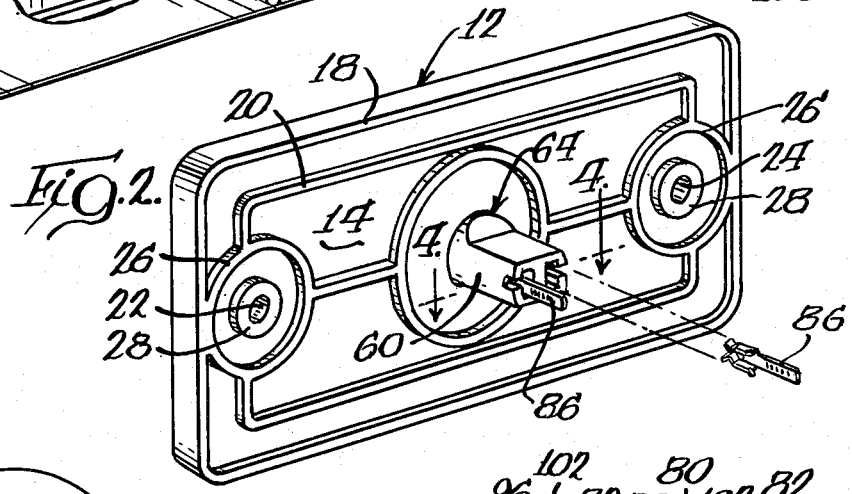
FIG. 2 is a partially exploded perspective view of the rear side of the base member with one of the connector pins secured in place and the other connector pin positioned immediately prior to its insertion into the base member.

The discussion of the assembly and operation of the light fixture 10 which follows recites the cooperation of the various structural elements of the integrally formed base member 12, the bulb 40 and the connector pins 86. Referring to FIG. 2, the connector pins 86 are inserted from the rear side of base member 12 into the corresponding channels 74 and 76 of socket member 60, such that as the ear sections 102 contact surfaces 106 they deflect inwardly and then as they reach and enter the grooves 82 they snap back to their original positions. When so positioned the connector pins 86 are retained in place and precluded from further inward movement by the contact between surfaces 104 of the connector pins and the surfaces 73 formed in the channels 74 and 76. The connector pins are precluded from outward movement by the contact between the ear sections 102 and the surfaces 84 formed at the outer ends of grooves 82. Accordingly, the connector pins 86 are easily snapped in place with minimal effort and little chance of them becoming dislodged during use of the light fixture.

The bulb 40 is received and retained in place by the connector pins 86. The base portion 44 of the bulb is inserted into the forward portion 64 of socket member 60 from the front side 16 of the base member 12 such that the side sections 46 and 48 of the bulb contact the outer surfaces of sections 98 and 100 and thereby spread them apart so as to permit the side sections 46 and 48 to pass therethrough and the center section 50 to enter channel 78. The base portion 44 is moved inwardly and the apexes of the sections 98 and 100 are received in the recessed portions 56 formed in the side sections 46 and 48 causing the sections 98 and 100 to snap back to their original position and securely retain the base portion 44 in place in contact with the connector pins 86. When so positioned the lead wires 52 and 54 are likewise in electrical contact with a corresponding connector pin 86. The body portion 42 of bulb 40 is supported in position in close proximity to the surfaces 68 and 70 to limit the movement of the bulb relative to the base portion 12. The bulb is readily removable from the light fixture for replacement.

As hereinabove discussed, the lens member 30 is positioned in covering relationship to the front side of the base member 12 with the offset edge portion 34 received in channel 32. The light fixture 10 may then be suitably secured to an appropriate surface by the passage of fastening means through openings 36 and 38 in lens 30 and corresponding openings 22 and 24 in base member 12. Although not specifically shown, the appropriate female portions of spade-type connectors attached to electrical leads may then be secured to the lead receiving portions 88 of the connector pins 86.

As can be appreciated from the above description, the light fixture 10 incorporates an integrally formed base plate member and socket member and eliminates the expense associated with the manufacture and assembly associated with fixtures which incorporate separate base plate members and socket members. Further, the specific configuration of the socket member and connector pins cooperate with each other to provide an assembly which is easily assembled and reliable in operation.

From the foregoing, it will be readily appreciated that numerous variations and modifications may be effected without departing from the true spirit and scope of the novel concept of the invention. It is to be understood that no limitation with respect to the specific structure illustrated herein is intended or should be inferred. It is, of course, intended to cover by the appended claims all such modification as fall within the spirit and scope of the claims.

What is claimed is:

1. A light fixture for receiving a wedge base light bulb having a body portion, and a base portion including a central portion and a pair of spaced apart generally flat side sections on respective opposite sides of said central portion, with contact wires respectively associated with a surface of each side section, with each said side section having a transverse recess formed therein, comprising: a generally flat base member having a front side and a rear side, said base member having a centrally disposed opening formed therein; a socket member connected with said base member at said centrally disposed opening and extending outwardly from said rear side of said base member, said socket member having a front section for receipt of a portion of said body portion of the bulb and a rear section for receiving said base portion of the bulb, said rear section having a pair of spaced apart channels integrally formed therein, and a central channel between said spaced apart channels shaped to receive a central portion of said light bulb base portion; and a connector pin means received and retained in each of said spaced apart channels for respectively receiving each of the side sections of said bulb so as to cooperate with said recess formed in each said side section and thereby retain said base portion of said bulb in a position within said socket member and to contact said contact wire associated with the corresponding side section, each said connector pin means including a clip portion for receipt of said respective side section of the base portion and for contacting said contact wire associated therewith, and a lead wire receiving portion for attachment of an electrical lead wire thereto, each said clip portion comprising a pair of spaced apart and facing spring clip sections extending integrally from opposite edges of said lead wire receiving portion, each said clip section having a first end defining a V-shaped section, the apexes of said V-shaped sections extending toward each other so that one of said V-shaped sections of the clip portion of each connector pin means is received in the transverse recess of the respective side section of the light bulb base portion, each of said spaced apart channels being formed with a pair of opposed longitudinally extending grooves integrally formed in said rear section of said socket member, with each of said grooves terminating a short distance from the rear end of said spaced apart channels to thereby define a first inwardly extending surface at the rear end of each said groove, said spaced apart channels each further being formed with a second inwardly extending surface, said clip portions of said connector pin means having a pair of spaced apart, outwardly extending inwardly resiliently deformable ear sections which respectively extend outwardly from second ends of said facing spring clip sections, said ear sections being respectively slidably received and retained within said grooves of each said channel by engagement of each said ear section with a respective one of said first inwardly extending surfaces, each said connector pin means being formed with a ledge portion at the inner edge of said lead wire receiving portion which provides a third surface which is engageable with said second inwardly extending surface of the respective one of said spaced apart channels, whereby each said connector pin means is insertable into the respective one of said spaced apart channels from the rear of said socket member and retained in position therein with said connector pin means precluded from movement in one direction by contact between said ear sections and said first surfaces, and precluded from movement in the other direction by contact between said second and third surfaces, the clip sections of each said connector pin means being urged away from each other attendant to receipt of a respective one of said side sections of said bulb base portion therebetween.

2. The light fixture as defined in claim 1, wherein said lead receiving portion of said connector pin means is generally flat and extends rearwardly of said clip portion to receive a female portion of a spade-type connector.

3. The light fixture as defined in claim 2, wherein said lead receiving portion is formed with outwardly extending ribs so as to facilitiate retention of the female portion of the spade-type connector.

4. The light fixture as defined in claim 1, wherein the front side of said base member is formed with a peripheral channel for receipt of an offset edge portion associated with a lens member secured to said base member.

5. The light fixture as defined in claim 4, wherein said lens member and said base member have cooperating holes formed therein for receipt of fastening means therethrough.

6. The light fixture as defined in claim 1, wherein said socket member is formed integrally with said base member.

* * * * *